US006591877B1

(12) United States Patent
Graffius

(10) Patent No.: US 6,591,877 B1
(45) **Date of Patent: *Jul. 15, 2003**

(54) BEVERAGE DISPENSER UNIT

(75) Inventor: Earl B. Graffius, Peachtree City, GA (US)

(73) Assignee: Hoshizaki America, Inc., Peachtree City, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/451,760

(22) Filed: Dec. 1, 1999

(51) Int. Cl.[7] ..... B65B 1/04
(52) U.S. Cl. ..... 141/360; 200/293; 222/129.1
(58) Field of Search ..... 200/302.2, 314, 200/513, 306, 141, 129.1–129.4; 222/146.6, 241, 368, 242, 239; 141/360, 361, 362

(56) References Cited

U.S. PATENT DOCUMENTS 3,582,612 A * 6/1971 Siemianowski ..... 219/213
3,851,127 A * 11/1974 Gardner, Jr. et al. ..... 200/61.86
3,853,682 A * 12/1974 Hurst ..... 161/92
3,931,911 A * 1/1976 Kohl ..... 222/56
3,934,691 A * 1/1976 Toloczko ..... 193/32
3,979,024 A * 9/1976 Hoppe ..... 222/67
4,554,419 A * 11/1985 King et al. ..... 200/5 A
4,590,975 A * 5/1986 Credle, Jr. ..... 141/1
4,851,662 A * 7/1989 Ott et al. ..... 250/214 AL
4,977,300 A * 12/1990 Schroeder ..... 200/293
5,033,273 A * 7/1991 Buchser et al. ..... 62/344
5,054,654 A * 10/1991 Schroeder et al. ..... 222/146.6
5,074,341 A * 12/1991 Credle, Jr. et al. ..... 141/1
5,299,716 A * 4/1994 Hawkins et al. ..... 222/146.6
5,390,714 A * 2/1995 North, III et al. ..... 141/369
5,429,681 A 7/1995 Mesenbring
5,505,192 A 4/1996 Samiotes et al.
5,662,955 A * 9/1997 Joseph, Jr. et al. ..... 426/432
6,093,312 A * 7/2000 Boulter ..... 210/86

FOREIGN PATENT DOCUMENTS

EP 0157035 * 8/1984

* cited by examiner

*Primary Examiner*—P. Austin Bradley
*Assistant Examiner*—Lisa N. Klaus
(74) *Attorney, Agent, or Firm*—Arent Fox Kintner Plotkin & Kahn

(57) ABSTRACT

Membrane switch is used to activate beverage and ice dispensing on a beverage/ice-dispensing machine. The switch is inexpensive and easy to clean and install. This switch is directly connected to a control board by a flat wire cable. An LED light can be mounted on switch to give feedback to the customer for current use status, low ice condition, or malfunction. Multi colored LEDs can be used to supply different conditions. The switch is simply mounted using an adhesively in an identically shaped indented portion on the front face of the molded housing.

11 Claims, 4 Drawing Sheets

BEVERAGE DISPENSER UNIT

BACKGROUND—FIELD OF INVENTION

This invention relates to the field of dispensers, specifically to dispensers of ice and beverages which have a switch wherein the same is arranged to operate a dispensing circuit controlling the dispenser.

BACKGROUND—DESCRIPTION OF PRIOR ART

Switches called membrane switches are a common component for many different types of machines. They can be seen on ATM machines, calculators, and many types of machines to transmit data. Generally, the use of the term "membrane switch" means that there is a thin, flexible member (membrane) facing over the switch which enables sealing of the area around the switch for use in an environment with liquids present.

The use of the membrane switch can be seen in U.S. Pat. No. 4,977,300 as a button to actuate a beverage dispenser. This switch is incorporated directly to the structure of the dispenser valve and can be used as a touch button that turns on when touched, and off when there is no longer contact, or it can be used to trigger a circuit to dispense a predetermined amount. This process makes for easy external maintenance, but no logic that controls the dispenser.

U.S. Pat. No. 4,977,300 to Schroeder teaches the use of a standard mechanical electrical switch with the membrane and actuating member being mounted such that the actuating member is sufficiently close to the switch to operate the same. As noted above, the switch is mounted directly in the dispensing valve head. A removable face plate carries the membrane and positions the same relative to the switch. Mechanical mountings are required for the switch and the plate. The overall switch unit has many pieces. The system is difficult to adjust and fit to the initial location. Precise measurements and dimensions are required.

U.S. Pat. No. 5,429,681 discloses a device for dispensing condiments into multiple containers at one time. A cover hood carries a waterproof keypad for selecting (switching) the operation to be run on the programmable control module. The keypad can have a waterproof membrane switch button plate on its front face which allows the user to input the number of food targets to be served. The back of the keypad includes a waterproof circuit and a waterproof flex cable which connects the keypad to the programmable control module. There is no particular disclosure as to how the keypad is mounted.

OBJECTS AND SUMMARY OF THE INVENTION

It is an object of the present invention to provide a simple switch and housing combination for an ice and beverage dispensing machine that is easy to manufacture, low cost, easy to install, easy to clean, very dependable, and water-resistant.

As such, the general purpose of the present invention, which will be described subsequently in greater detail, is to provide a new and improved simple switch and housing combination which has all the advantages of the prior art simple switch and housing combination and none of the disadvantages.

Present invention has the advantage that a simple membrane unit can be used which is adhesively fitted to the molded housing. The housing can be simplified. No critical measurements or selection of actuating member is required. The integral cable can be run through a slot in the housing front. Simple taping of the flat cable provides sufficiently secure mounting of the unit. The membrane switch can have one or more LEDs mounted therein to signal desired functions. For example, the LED could be used to indicate when the dispensing functions is working. Alternatively, the LED could indicate when the ice machine with which the switch is being used is low on ice. The switch is low cost, etc etc.

A simple flat cable connector provides leads to the control box containing the circuit for controlling the various valves etc of the ice/beverage dispenser. A simple slit in the box cover enables the control box to be closed with a direct connection being enabled to the membrane switch. The switch is only 1 mm thick. A shaped recess or indented portion is provided in the housing face by molding. The recess is substantially the same shape as switch and is only 1 mm deep. The switch is mounted in recess by simple attachment with conventional adhesive. A slot is provided at the upper edge of the recess to pass the flat cable from the switch to the interior of the machine. In this manner, there are no connections visible to the user. The cable is held in place in the interior by simple taping.

My invention resides not in any one of these features per se, but rather in the particular combination of all of them herein disclosed and claimed and it is distinguished from the prior art in this particular combination of all of its structures for the functions specified.

This invention allows for a membrane switch to be used to activate beverage and ice on a dispensing machine. The switch is connected to a control board where logic can be introduced into the circuit. This logic can consist of counting numbers of time ice is dispensed, time between dispensing functions and can control periodic agitation. Portion control can be set to determine how fast to dispense ice. Since there is more than one function—the logic can control that only one function at a time if desired (only ice at one time or only water). There can be an LED light mounted on membrane switch so as to show when the dispensing function is working (or if the machine is low in ice). A multi colored LED light can be used to show multiple indicators. There is a time delay built in so that sliding of a user's finger on the button won't cause "chatter" or continuous on/off responses.

The mounting of the membrane switch is very simple. The housing is molded using a mold shaped for the particular shape of the switch. The depth of the indentation for the switch is made to make the switch flush with the housing face or cabinet. There are no bolts or screws needed, due to the use of adhesive to seal the switch to the cabinet.

The ease of this piece in comparison to prior art is that it is one piece, it is small, and it easy to store. While other membrane switches might have multiple connectors and wires this switch is one button connected to a flat cable or cord that connects to the control board. The aesthetics of this piece makes this machine have a more streamlined look that enhances the graphics. The membrane switches can be made in any size, color, or shape and can have any indicia on their face. That is, the face of the switch can be labeled to show the particular product being dispensed by that switch.

Other objects, features, and advantages of this invention will become evident in light of the following description of the invention.

BRIEF DESCRIPTION OF THE DRAWINGS

The above and other objects and the attendant advantages of the present invention will become readily apparent by reference to the following detailed description when considered in conjunction with the accompanying drawings wherein:

FIG. 2*a* shows a cross-sectional view of the front portion of the housing while

DETAILED DESCRIPTION OF A PREFERRED EMBODIMENT

Figure 1:
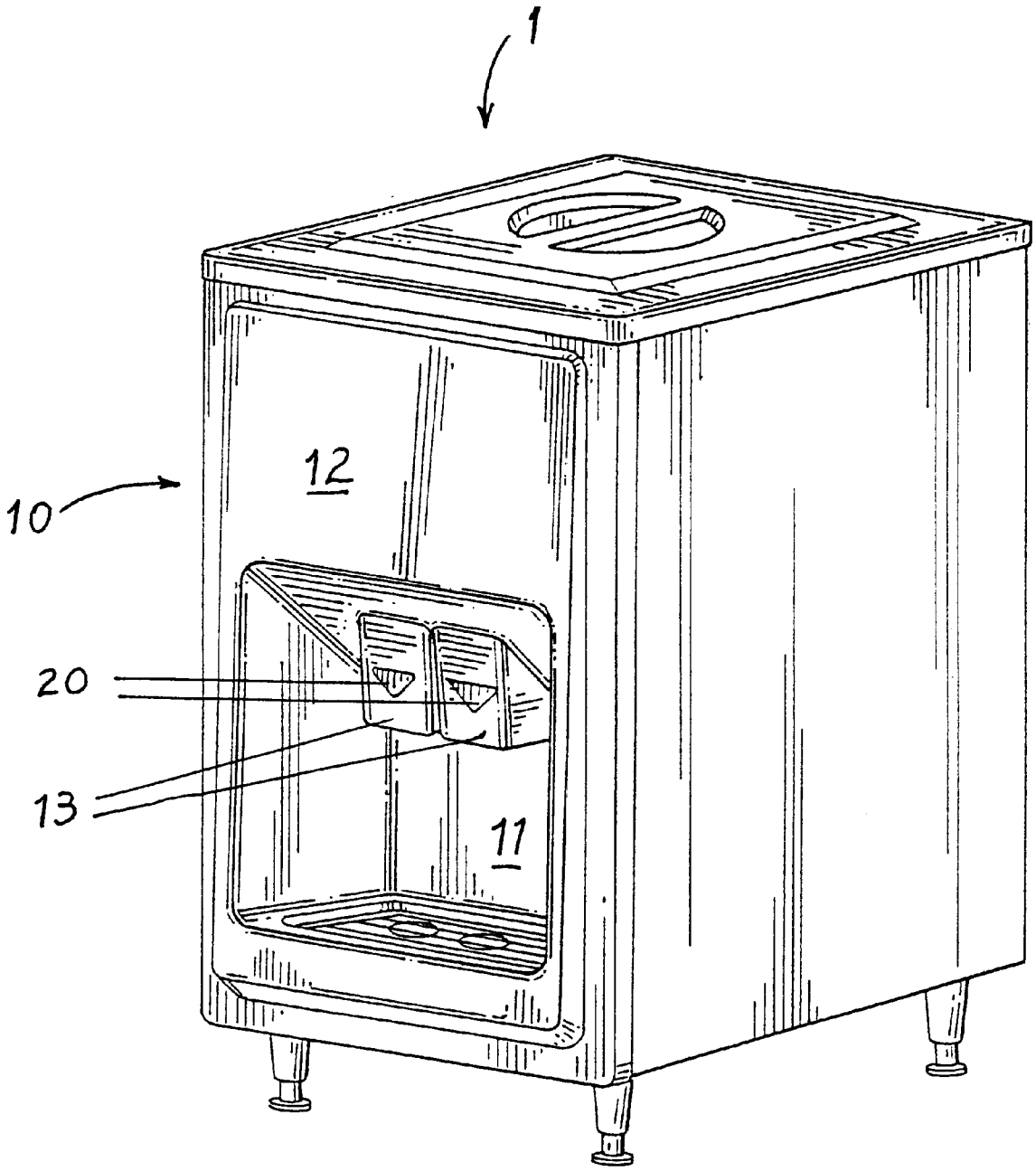
FIG. 1 shows a perspective view of a beverage and ice dispenser according to the present invention.

FIG. 1 shows a perspective view of a beverage and ice dispenser 1 having a molded housing member 10 forming the front of the dispenser 1. The front face 12 of the housing member 10 has a portion 11 designed to receive a container into which ice and/or a beverage is to be dispensed. In the upper part of the portion 11 are a pair of chutes 13 one of which being operatively associated with the ice making machine (not shown) while the other is operatively associated with a dispenser device (not shown) for dispensing the beverage. A pair of membrane switches 20 described hereinafter are mounted on the front face 12 of the housing member 10 at about the position of the chutes 13.

Figure 2A:
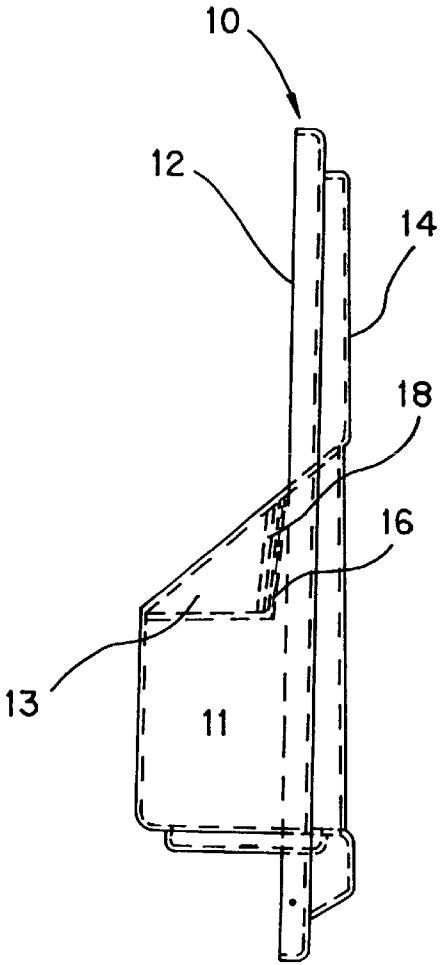
Figure 2B:
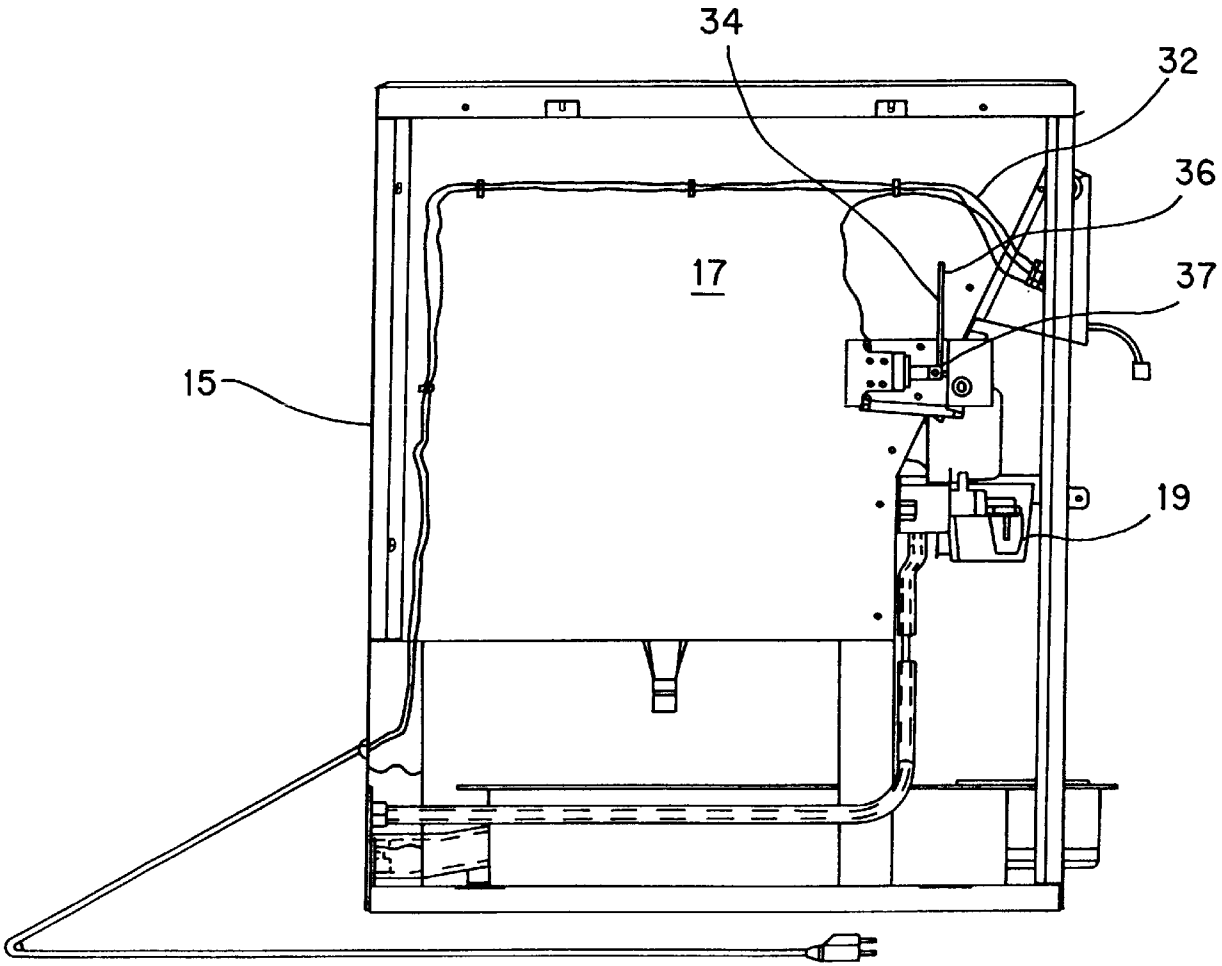
FIG. 2*b* shows a cross-sectional view of the rear portion.

FIG. 2*a* shows a cross-sectional view of the housing member 10 having the front face 12 and the rear face 14. On the front face, a shaped indented portion 16 is provided having a particular geometric shape. The indented portion has a particular depth. At the top edge portion of the indented portion 16 is provided a slot 18.

Figure 3:
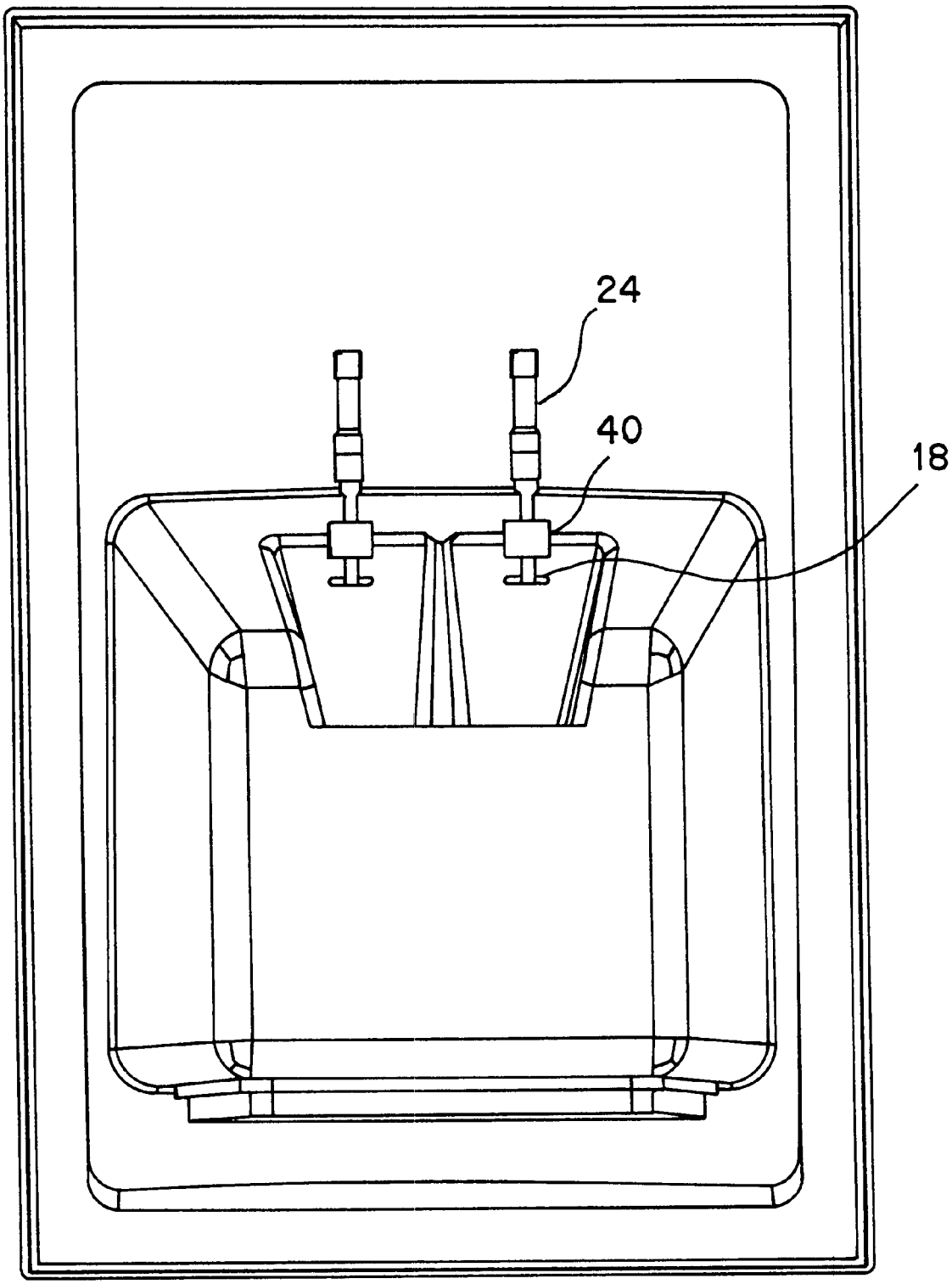
FIG. 3 shows the rear face of the housing member taken off of the housing.
Figure 4:
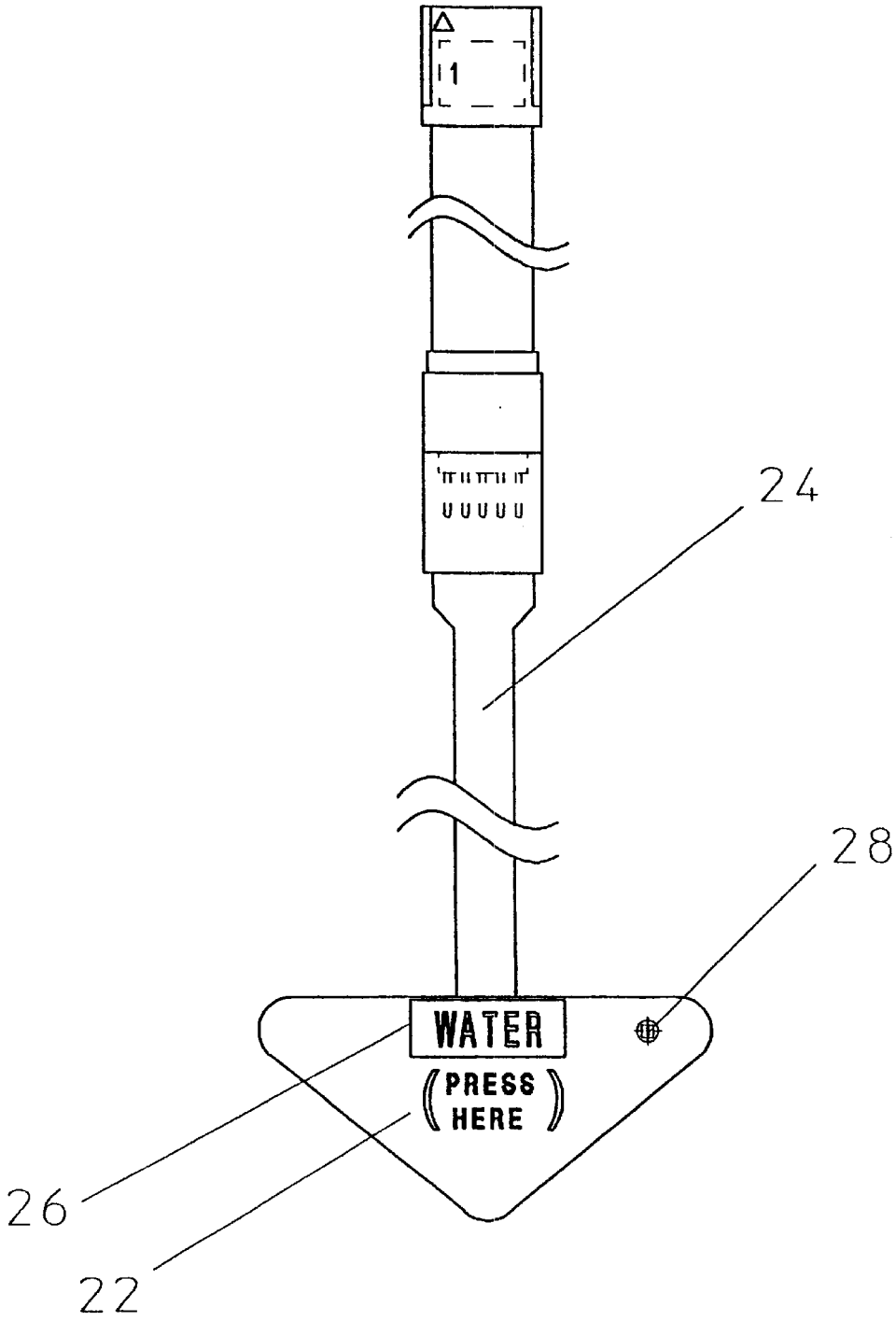
FIG. 4 shows a diagrammatic view of the membrane switch.

FIG. 4 discloses the membrane switch 20 in accordance with the present invention which has a body 22 of the substantially the same shape as the indented portion 16 and a thickness substantially identical to the depth of the indented portion. As can be seen in FIG. 1, the switch body is held in the indented portion. An adhesive is used to hold the switch body 22 in place. The flat wire cable 24 of the switch passes through the slot 18 and extends upwardly. As can be seen in FIG. 3 showing the flat cable 24 passing through the slot 18, the cable 24 is held in position on the rear face 14 of the housing member by a piece of tape 40.

As shown in FIG. 4, the body 22 of the switch can have indicia 26 on it indicating the material such as ice or water as a beverage which would be dispensed by actuation of the switch. In addition, an LED 28 can be provided on the switch body 22.

The housing member with one or more switches on it with the flat cables 24 extending through the slots 18 is mounted to the main housing body 15. Contained within the main housing body 15 is an ice making machine 17 and one or more dispensing mechanisms 19. Since the ice making machine 17 and the dispensing mechanisms 19 form no specific part of the present invention, further description is not being provided.

Also contained within the rear portion 15 is a control system 30 mounted in a circuit control box 32. That is, the control system 30 for controlling the ice machine and the dispenser devices is provided with a control circuit board 34 having thereon a control circuit 36. A flat circuit cable 37 extends from the control circuit 36 through a slit 38 in the control box 32. An appropriate connector is provided on the flat circuit cable 37 to connect it to the flat wire switch cable 24.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A dispenser unit, comprising:

a molded housing member having a front face and a container-receiving compartment formed into the front face;

at least one chute disposed within the container-receiving compartment and connected to and depending downwardly from the molded housing member, the at least one chute having an indentation formed into the at least one chute and facing exteriorly of the container-receiving compartment and a slot extending through the at least one chute and in communication with the indentation; and at least one membrane switch assembly for each chute including a membrane switch body having a first side surface and an opposite second side surface and a flat wire cable operably connected to the membrane switch body at the first side surface, the membrane switch body sized and adapted to be received within the indentation and the flat wire cable sized and adapted to extend through the slot, wherein the at least one membrane switch assembly being adhesively attached at the first side surface to the at least one chute in the indentation and the second side surface facing exteriorly of the container-receiving compartment and covering the indentation.

2. A dispenser unit according to claim 1, wherein the indentation has a depth formed into the at least one chute such that, when the at least one membrane switch assembly is adhesively attached to the at least one chute, the at least one membrane switch assembly is flush with the at least one chute.

3. A dispenser unit according to claim 1, wherein the at least one membrane switch includes an LED light mounted thereon and facing exteriorly of the container-receiving compartment.

4. A dispenser unit according to claim 1, wherein the second side surface includes indicia thereon indicating what is to be dispensed.

5. A dispenser unit according to claim 1, wherein the first side surface is adhesively attached to the at least one chute by tape.

6. A dispenser unit according to claim 1, wherein the membrane switch body is triangularly shaped.

7. A dispenser unit according to claim 1, further comprising a tape element sized to contact the flat wire cable in a manner to secure the flat wire cable to a support structure.

8. A dispenser unit according to claim 1, wherein the molded housing member and the at least one chute are formed as an integral construction.

9. A dispenser unit according to claim 1, wherein the container-receiving compartment is defined by a ceiling panel, a floor panel, a rear wall connected to and between the ceiling panel and the floor panel and a pair of side walls, each side wall connected to the rear wall, ceiling panel and floor panel.

10. A dispenser unit according to claim 9, wherein the at least one chute is integrally formed with and depends downwardly from the ceiling panel.

11. A dispenser unit according to claim 9, wherein the ceiling panel extends downwardly at an angle from the front face and inwardly towards the rear wall.

* * * * *